United States Patent [19]

Diller

[11] Patent Number: 4,893,716

[45] Date of Patent: Jan. 16, 1990

[54] CLAW COUPLING FOR TOY AND MODEL TRAINS

[75] Inventor: Hans Diller, Heroldsberg, Fed. Rep. of Germany

[73] Assignee: Gebr. Fleischmann, Nuremburg, Fed. Rep. of Germany

[21] Appl. No.: 235,346

[22] Filed: Aug. 23, 1988

[30] Foreign Application Priority Data

Aug. 25, 1987 [DE] Fed. Rep. of Germany ..... 3728240

[51] Int. Cl.[4] ..... B61G 1/00

[52] U.S. Cl. ..... 213/75 TC; 213/89; 213/90

[58] Field of Search ..... 213/75 TC, 86, 87, 88, 213/89, 98, 99, 193, 90, 75 R, 172, 173, 211, 121, 142, 144, 145, 146, 148

[56] References Cited

U.S. PATENT DOCUMENTS

| | | | |
|---|---|---|---|
| 595,166 | 12/1897 | Greiner | 213/90 |
| 2,631,739 | 3/1953 | Bonanno | 213/211 |
| 3,134,489 | 5/1964 | Gillham | 213/75 TC |
| 3,662,489 | 5/1972 | Terrier | 213/75 TC |
| 3,678,618 | 7/1972 | Beny et al. | 213/75 TC |
| 3,831,776 | 8/1974 | Antonik | 213/75 TC |
| 4,098,411 | 7/1978 | Rossler | 213/75 TC |
| 4,650,081 | 3/1987 | Diller | 213/75 TC |
| 4,765,496 | 8/1988 | Diller | 213/75 TC |

*Primary Examiner*—Andres Kashnikow
*Assistant Examiner*—Mark T. Le
*Attorney, Agent, or Firm*—Jordan and Hamburg

[57] ABSTRACT

A claw coupling for toy model trains includes a coupling support head having a hook and a claw along with a pivotal support pivotably mounting the claw on the coupling support head for movement between a coupled and an uncoupled position. A decoupling pin depends from the claw, and the coupling support head has an opening in which the decoupling pin is received, the decoupling pin being engageable by a decoupling rail to raise and pivot the pin in the opening. The claw has two arms disposed generally at right angles to one another, one of the arms having the aforementioned hook, the other arm having the aforementioned depending decoupling pin. The coupling support head has a mandrel operable to be disposed in a position juxtaposed to the other of said arms of a claw of another like coupling to preclude the last said claw from pivoting to a decoupling position. The pivotal support includes a pivot pin extending from the claw and a hole in the coupling support head in which the pivot pin is received, the hole having at least a partial conical surface to prevent the pivot pin from being wedged in the hole as the pin is moved axially in the hole.

7 Claims, 5 Drawing Sheets

CLAW COUPLING FOR TOY AND MODEL TRAINS

This invention relates to a claw coupling for electric toy and model trains and includes a claw which can be hooked from the side into a rigid fork of the respective outer support and which can be pivoted in a horizontal plane. A journal is mounted in a bore where the journal can be lifted upwardly against gravity from its coupling position into a decoupling position by means of a coupling lifter on a decoupling rail which engages a downwardly protruding decoupling pin. The claw has an outer arm that can be hooked into the rigid hook and it has an inner arm at a 90° angle thereto, the mounting and the journal being always disposed at the outer edge of the bearing or of the claw, respectively. The bearing has a run-up mandrel for the inner arm of the claw of the respective counter-coupling part, and the bearing is designed so that when the claw is lifted up, it is constrained by a guide to pivot inwards and to be set down on the outer support, and the run-up mandrel is dimensioned such that it prevents the respective counter claw from pivoting up into a decoupling position. When reverse running, it also prevents an inwardly set-down claw from pivoting to the outside.

Such a claw coupling was described in an older patent application, P No. 36 01 951 8. It avoids the difficulties of the previous so-called Fox coupling (DE-OS No. 20 41 361). In this coupling, the claw was still braced in its coupling position by a swivel-readjusting spring. The fabrication and assembly of the extremely small components, especially the helical spring, presented considerable difficulties. By virtue of the special coupling design of the above-mentioned older application, which makes do without the readjusting spring, and which uses a run-up mandrel, claw couplings can be fabricated even for very small electric toy and model trains such that no major problems occur any more both as regards the manufacture of the individual parts and as regards their assembly.

The small coupling components, and especially the claw, have an extremely low weight. The claw must be raised and then naturally must fall back again downwardly from its raised position purely under the action of gravity. Under unfavorable conditions, especially under extreme vibration, difficulties can occur in the sense that the claw does not fall down again from its raised position quickly enough and completely enough and in the sense that the bearing pin wedges in its associated bore because of its skewed position.

The invention therefore has the objective of providing a claw coupling of the type mentioned in the introduction, in such a fashion that the claw can no longer be shaken loose and can no longer remain stuck, even under unfavorable conditions, and that this can be achieved without significantly increasing the manufacturing or assembly expense.

To achieve this objective, the invention provides that the mounting for the journal is expanded conically downwardly at least on one side to avoid wedging itself as it rises.

This expansion of the mounting bore downwardly prevents the journal from jamming in the mounting bore when it is only slightly slanted with respect to the vertical axis, as was previously the case. Because of the unavoidable manufacturing tolerances for the tiny parts of such couplings for gauge N, such a jamming previously could never be entirely excluded, even during normal vertical lifting.

The inventive expansion of the bearing bore downwardly eliminates the danger that the claw, once it has been raised intentionally or unintentionally, will no longer fall downwardly. But a further development of the invention very simply counters the danger of loosening by vibration, i.e., an unintended raising of the claw, which may be caused by the smallness and lightness of the components. This is achieved by providing the rigid hooks and the claws with mutually contacting slanted surfaces. The mutually contacting surfaces of the hooks and the claws are designed so that, with the rigid hooks, the slanted contact surface for the claw faces downwardly and the corresponding surface on the claw faces upwardly.

Further advantages, features and details of the invention are found in the following description, as well as in the accompanying drawings.

DESCRIPTION OF THE PREFERRED EMBODIMENTS

Figure 1:
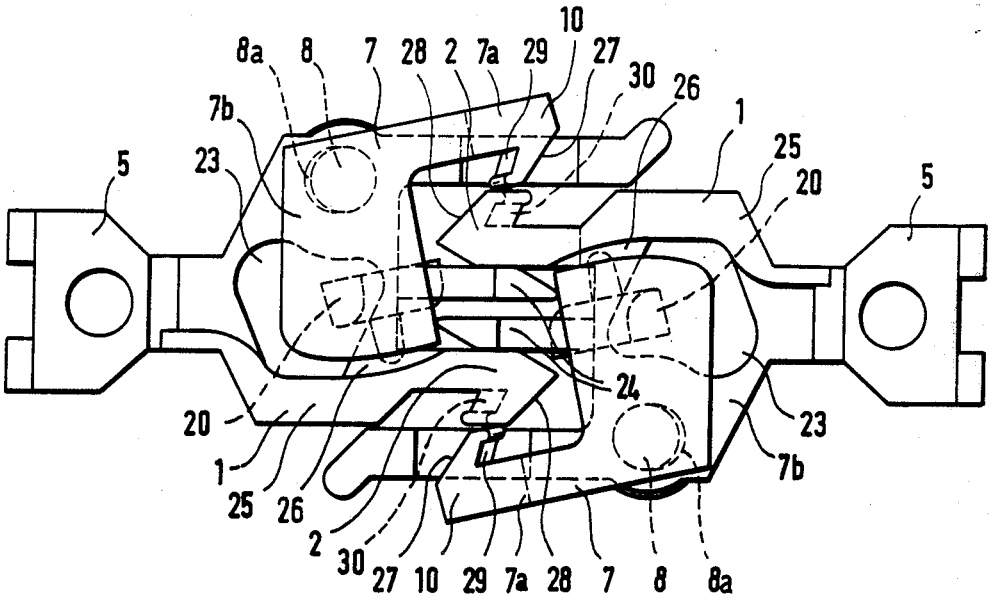
FIG. 1 is an enlarged top view of two coupling heads during the coupling process when the vehicles come together.

Each coupling head comprises a bearing part 1 with a rigid outwardly pointing hook 2 at its front end and with a plug connector section 5 for connection into standardized receiving shafts, e.g., according to the European model train standard NEM 362. A claw 7 is disposed on the bearing part 1. Its journal 8 is disposed outside in the angle region between the hook section 7*a* and the inside leg 7*b*. The journal 8 engages a bore of the bearing part 1. The claw 7 has a hook head 10.

Figure 3:
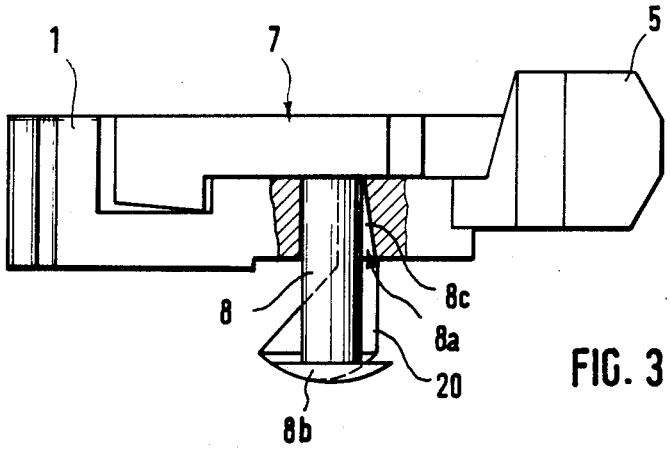
FIG. 3 is a sectional view taken along the line III—III in FIG. 2.
Figure 4:
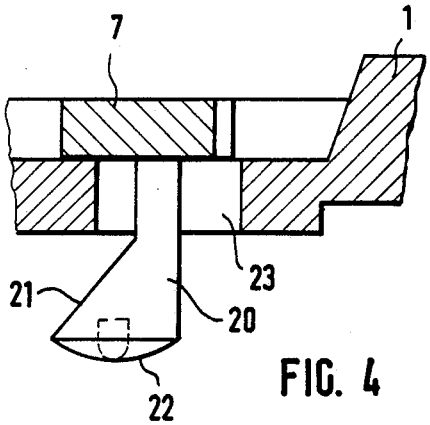
FIG. 4 is a sectional view taken along the line IV—IV in FIG. 2.
Figure 5:
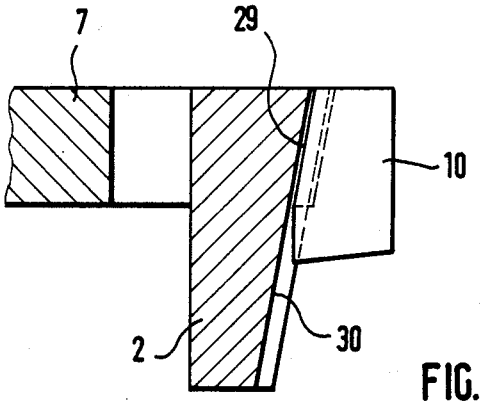
FIG. 5 is a partial sectional view taken along the line V—V in FIG. 2.
Figure 6:
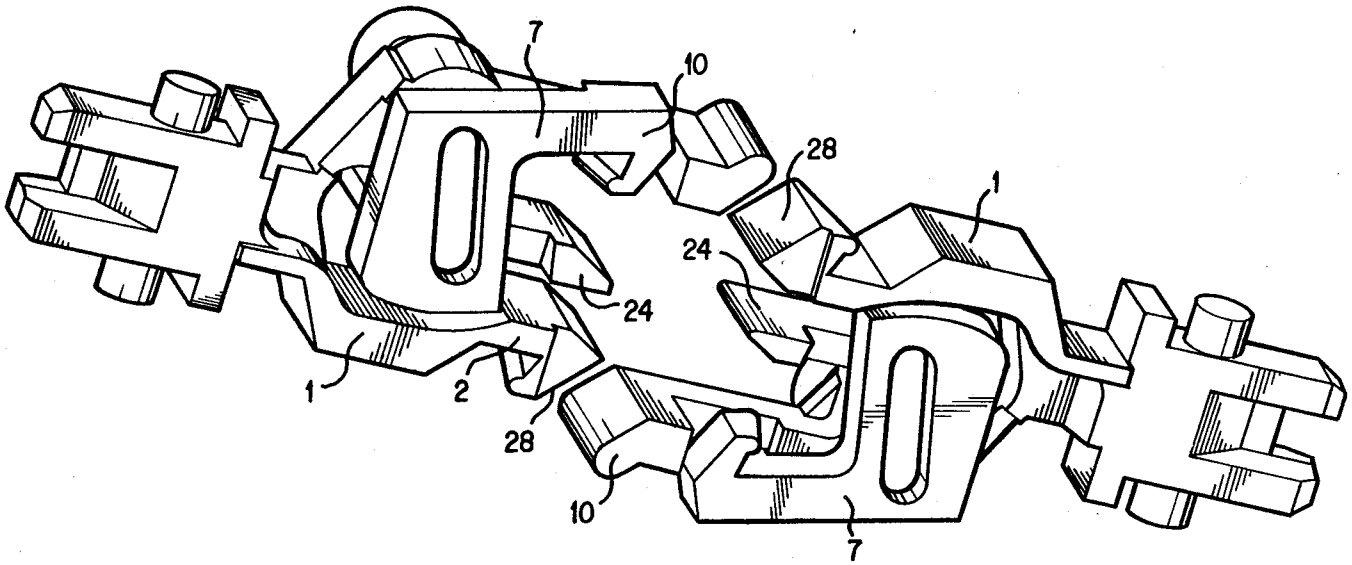
FIG. 6 is a perspective view showing the parts in a position similar to the FIG. 1 position.
Figure 7:
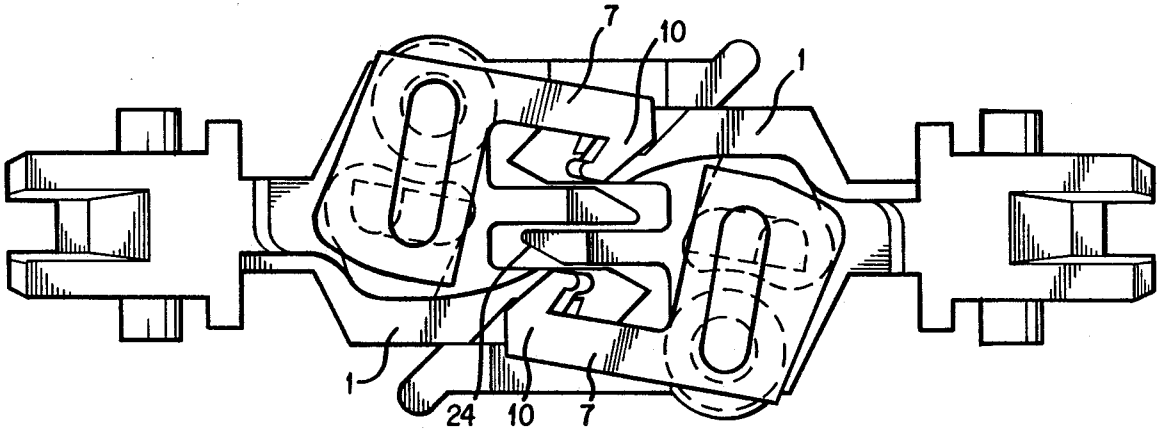
FIGS. 7 and 8 are plan and perspective views respectively showing the inward pivoted position.
Figure 8:
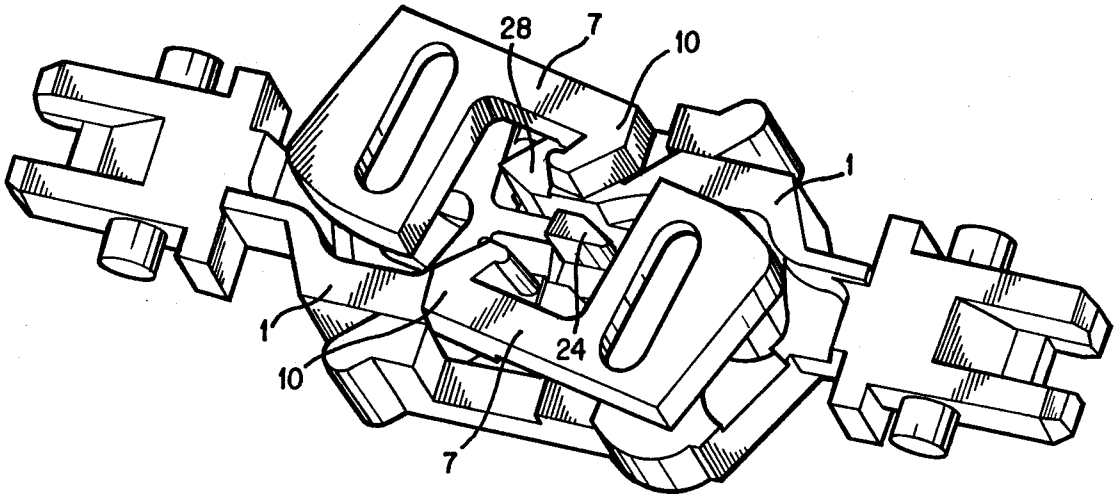

As can be seen especially in FIG. 3, a mounting bore 8*a* with the journal 8 is equipped with a quasi-conical expansion 8*c* on its back side. The lower end of the journal 8 has a broadened head 8*b* to prevent it from coming out from the mounting bore. The expansion 8*c* prevents wedging of the journal 8 in the mounting bore 8*a* when it is in its raised state. Thus the claw 7 cannot remain unintentionally stuck in its raised position. Rather, in every case, it reliably again falls down into the coupling position unless it has been set down in a pivoted position by a predecoupler which will be explained in more detail below.

Figure 2:
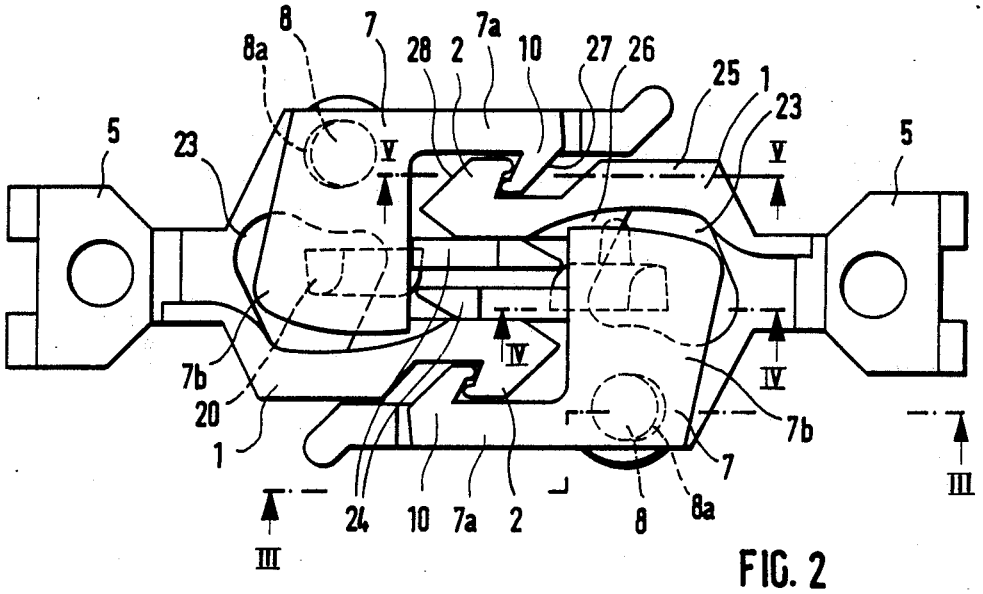
FIG. 2 is a view showing the coupling position.

A swivel pin 20 is integrally attached to the inside leg 7*b* of the claw 7. The lower end of this swivel pin has a thickened part 22 which forms a run-up incline 21. This swivel pin passes through a recess 23 in the bearing part. The run-up incline 21 is designed so that when the claw 7 is raised by a decoupling rail, the run-up incline 21 in combination with the edges of the recess 23 forcibly pivots the claw 7 inwardly. In contrast to the prior Fox couplings, it is not the journal but this swivel pin 20 that forms the decoupling pin. After the decoupling rail has been traversed, the claw, which is now in an inwardly pivoted position, falls downwardly and contacts the respective outer support 1. In this way, a new recoupling becomes possible only after the cars have been pulled away from one another. Thus, the claw 7 can again fall down into its normal lower position. Gravity only acts as a vertical reset force. Run-up mandrels 24 have a front end which is engageable with the stop 7*b* and the opposite ends of the run-up mandrels are connected to the respective bearing part 1. With such predecoupled reverse operation, the run-up mandrel 24 will press against the inside leg 7*b*, so that the entire claw is pressed inward and thus the hook ends 10 also remain hooked on the hook 2 of the counter-coupling. This can be achieved, for example, by designing the run-up mandrels 24 in such a fashion that they are raised with respect to the surface 25 of the coupling parts, and by the run-up mandrels still lying in the raised plane of the inside leg 7*b* of the claw when they are in the reverse position in which the coupling parts are pushed more together. If the claw should undergo a pivoting motion toward the side, the inside leg 7*b* would then immediately abut against the drawn-up run-up mandrel 24 and would thus prevent the claw from pivoting outwardly. This does not depend solely on the height of the run-up mandrels, which indeed must be present and effective even in the raised position of the claws, but also on the length, i.e , the extent by which the couplings can be pressed together. In order to lengthen this path for example, the outer support can have a recess in the area 26 (FIG. 2) , so that the coupling parts can move even closer together, thus affording even less possibility for the claw to move in an upswing motion.

Run-up inclines 27 at the hook heads 10 and counter run-up inclines 28 at the rigid hooks are also necessary for the functioning of the inventive claw coupling. Indeed, these make sure that the hook heads 10 are guided safely over the hooks 10 during the coupling process, even if at first they should be swung somewhat inwardly. Only when they are swung up this far, and the hook heads have arrived behind the hooks 2, may the run-up mandrel 24 become effective.

The run-up mandrels 24 finally should also be disposed in such a fashion that they closely adjoin one another laterally and thus secure the coupling against shear motion. Such lateral displacement of the couplings against one another otherwise would have to be intersected by the hook head 10 of the claws, which could thereby break out.

When two couplings are run together (compare especially FIGS. 1 and 2), the inside leg 7*b* of each claw impacts a run-up mandrel 24 of the respective outer support, whose length must be dimensioned so that it prevents the claws 7 from spontaneously again swinging up outwardly into the decoupling position (for example, caused by vibration). Decoupling thus is possible only by raising the claws 7 with respect to the hook 2. The design can be such that the run-up mandrels 24 have a very small axial spring-like compressibility. This can be achieved, for example, by the indicated tip, so that the run-up mandrel always makes flexible contact with the inside leg 7*b* of the counter claw 7. This very greatly impedes the coupling from "being loosened by vibration" during a bumpy run.

The coupling is secured still further against "being loosened by vibration" by the special design of the mutually contacting surfaces of the rigid hooks 2 and claws 7. These surfaces 29 and 30 are in fact designed in such a fashion that the contact surface 30 of the rigid hook 2 faces downwardly at a slant and overlaps the upwardly facing slanted surface 29 of the claw 7. In this way, the claws with the rigid hooks can be disengaged only after a certain lengthwise displacement, or with the application of a force which does not occur during normal vibrations, but which is effortlessly attained through the decoupling rail.

The conical borehole 8*c* causes claw 7, in the coupled state and in the pulling mode of driving, to be placed at a slight angle. This is an additional safeguard against claw 7 "shaking up" while the train is moving. The vertical position of claw 7 in the uncoupled position is ensured by the swivel pin 20. This carries out a lateral swivel motion with simultaneous lifting, as a result of which the straight side of the swivel pin 20 comes to lie against the wall of recess 23 and thus supports claw 7 and holds it in a vertical position. In FIG. 1, claw 7 is not raised but only swiveled laterally, corresponding to the state during coupling. This means that claw 7 is at a height level with the bearing part 1 and can therefore not lie upon this.

What I claim is:

1. A claw coupling for toy model trains comprising a . coupling support head having hook means, claw means, pivotal means pivotably mounting said claw means on said coupling support head for a movement between a coupled and an uncoupled position, a decoupling pin depending from said claw means, said coupling support head having opening means in which said decoupling pin is received, said decoupling pin being free to move in said opening means, said claw means having two arms disposed generally at right angles to one another, one of said arms having said hook means, the other of said arms having said depending decoupling pin, said coupling support head having a mandrel operable to be disposed in a position juxtaposed to the other of said arms of a claw means of another like coupling to preclude the last said claw means from pivoting to a decoupling position, said pivotal means comprising a pivot pin extending from said claw means and a hole in said coupling support head in which said pivot pin is received, said hole having at least a partial conical surface to prevent said pivot pin from being wedged in said hole as said pivot pin is moved axially in said hole.

2. A claw coupling according to claim 1, wherein said pivot pin and said hole each have a generally vertical axis, said conical surface having a larger end and a smaller end, said larger end being disposed below said smaller end.

3. A claw coupling according to claim 2, wherein said conical surface extends along one side of said hole.

4. A claw coupling according to claim 1, wherein said hook means and said claw means have slanted surfaces which prevent said claw means from rising as a result of vibration.

5. A claw coupling according to claim 4, wherein said pivotal means pivotably support said claw means for pivotal movement about a general vertical axis, said slanted surfaces being disposed at an acute angle relative to vertical.

6. A claw coupling according to claim 5, wherein said hook means and said claw means each have generally U-shaped ends each having leg portions extending from a base portion, said slanted surfaces being at said base portions.

7. A claw coupling for toy model trains for coupling and uncoupling to a like claw coupling, comprising a support head having hook means, claw means, pivotal means pivotably supporting said claw means on said support head, said claw means having a pivoted coupling position in which the claw means engages and couples the hook means of another like claw coupling, said claw means having two leg portions disposed at right angles to one another, one of said leg portions having a claw part which engages and couples the hook means of another like claw coupling, said support head having an elongated mandrel, the other of said leg portions of said claw means being engageable by the mandrel of another like claw coupling to preclude the last said claw means from pivoting from its pivoted coupling position, said pivotal means comprising a pivotal pin extending from said claw means and a hole in said support head in which said pivot pin is received, said hole having at least a partially conical surface to prevent said pivot pin from being wedged in said hole when said pin is moved axially in said hole.

* * * * *